United States Patent [19]

Brain

[11] Patent Number: 4,576,601

[45] Date of Patent: Mar. 18, 1986

[54] DIAPER MAGIC, OPEN PLASTIC PANTS TO HOLD CLOTH DIAPERS OR DISPOSABLE LINER

[76] Inventor: Lucille M. Brain, Rte. 1 Box 309 C, Hawthorne, Fla. 32640

[21] Appl. No.: 646,489

[22] Filed: Sep. 4, 1984

Related U.S. Application Data

[63] Continuation of Ser. No. 304,319, Sep. 21, 1981, abandoned.

[51] Int. Cl.[4] ..... A41B 9/04

[52] U.S. Cl. ..... 604/398; 2/406; 604/401

[58] Field of Search ..... 2/403, 406, 111; 604/391, 392, 393, 398, 401

[56] References Cited

U.S. PATENT DOCUMENTS

| | | | |
|---|---|---|---|
| 3,000,381 | 9/1961 | Mulhole et al. | 604/401 X |
| 3,483,864 | 12/1969 | DeZacarias | 604/401 X |
| 3,688,767 | 9/1972 | Goldstein | 604/401 X |
| 3,900,032 | 8/1975 | Heurlen | 604/401 X |

FOREIGN PATENT DOCUMENTS

| | | | |
|---|---|---|---|
| 1520740 | 8/1978 | United Kingdom | 2/406 |

*Primary Examiner*—H. Hampton Hunter
*Attorney, Agent, or Firm*—Dennis P. Clarke

[57] ABSTRACT

A diaper holder comprising of vinyl material material for cloth diapers, having horizontal bands of double vinyl secured at the ends to form an open loop at the top and bottom below the waistbands to hold standard cloth diapers securely in place. The lateral sides of the holder are incurved and elasticized to form leg embracing openings. The waistbands are double vinyl and size adjustable with the use of a releasable fastener of hook and pile. Also as a liner when covered with fabric.

9 Claims, 5 Drawing Figures

DIAPER MAGIC, OPEN PLASTIC PANTS TO HOLD CLOTH DIAPERS OR DISPOSABLE LINER

This is a request for filing a continuation of pending prior application Ser. No.: 304,319, filed on Sept. 21, 1981 now abandoned.

OBJECTS

Accordingly several objects of my invention are a method of putting plastic pants and diaper on a baby in one step using no safety pins. Another is to also benefit the ecology by using a disposable liner or a manufactured pad with adhesive strips on the back which would cut down on waste. The plastic pants are reusable. Mothers who prefer cloth diapers will find my invention saves time and works very efficiently compared to pinning on cloth diapers and pulling on tight plastic pants. When taking baby out or traveling a disposable pad could be substituted for the cloth diaper. They wash and wear well and are ideal for toilet training. Also, they are easier to use for the handicapped. The main object of this invention is to eliminate the inconvenience and danger of safety pins in attatching a cloth diaper to a baby and the use of tight plastic pants. The waist has an adjustable releasable closure of hook and pile and the bands at the back and front of the holder hold a standard cloth diaper securely without slipping when placed over and under the bands giving more concentrated absorbency than conventional method of pinning. The overlapping in the hip area on each side allows air to circulate with movement to deter diaper rash while elastic in leg openings prevents leakage.

Further objects and advantages of my invention will become apparent from a consideration of the drawings and ensuing discription thereof.

DESCRIPTION

Figure 1:
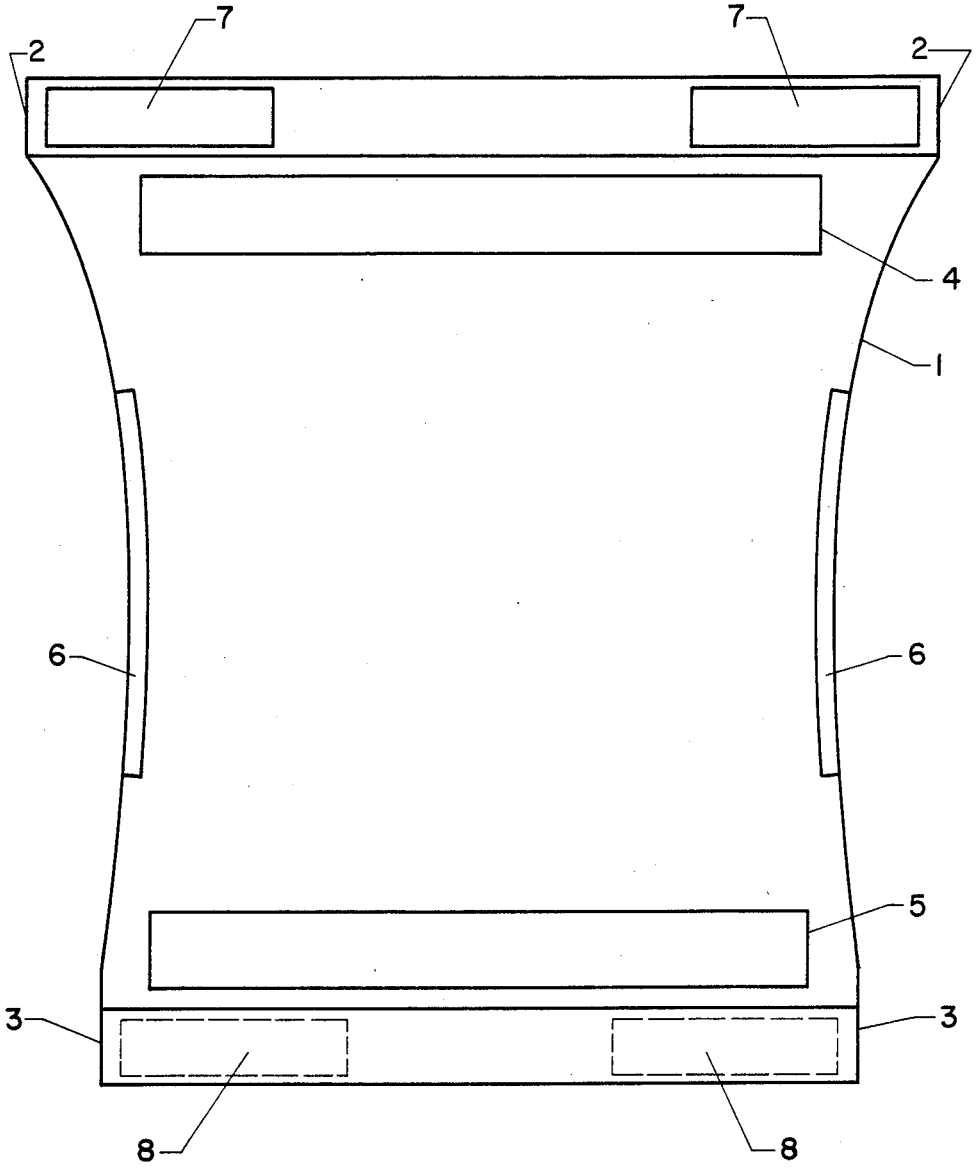
FIG. 1 is a perspective view of my invention. No. 1 refers to the shell which consists of a plastic material suitable for infants plastic pants. No. 2 is the top waistband which is double plastic reinforced with a strip of cotton fabric inserted between the plastic. No. 3 is the bottom waistband which is also double plastic reinforced with cotton fabric. No. 4 and No. 5 is a double strip of plastic sewn down at the left and right ends to form an open loop. No. 6 is a narrow strip of elastic which is gently gathered on each side to form leg openings. No. 7 is a strip of pile fastener placed at the left and right end of the top waistband on the inside. No. 8 is a strip of hook fastener placed at the left and right end of the bottom waistband on the outside.

The diaper holder is made of inextensible waterproof material such a vinyl sheeting or the like. The shape is generally rectangular, wider at the top 2 then bottom 3 and incurved in the center to permit passing through of legs, this area 6 employs elastic tape by zig zag stitching or equivalent technique to provide leg embracing portions, therefore the leg embracing portions are extensive and elastic. The waistbands 2 and 3 are made by folding the top and bottom edges over to form double vinyl waistbands, either sewn, welded or glued and and may be reinforced with cotton fabric between. The waistband is adjustable to fit the waist size by the use of strips of releasable closure of hook and pile 7 and 8 positioned at either ends of the waistbands. Located directly below the waistbands 2 and 3 are double vinyl bands 4 and 5 and either sewn, welded or glued at each end to form an open loop.

OPERATION

Take the flat plastic pants, fold the diaper the width desired, place it on the pants, tuck it over and under the plastic loops on the top and bottom of the pants. Position the baby on the diaper, pull the bottom end up between the legs. The larger top waistband is brought over the bottom waistband on each side and fastened with the Velcro to fit the size of the baby's waist. This design has the tightness in the legs yet still lets air circulate, therefore is a deterrant to diaper rash.

Figure 2:
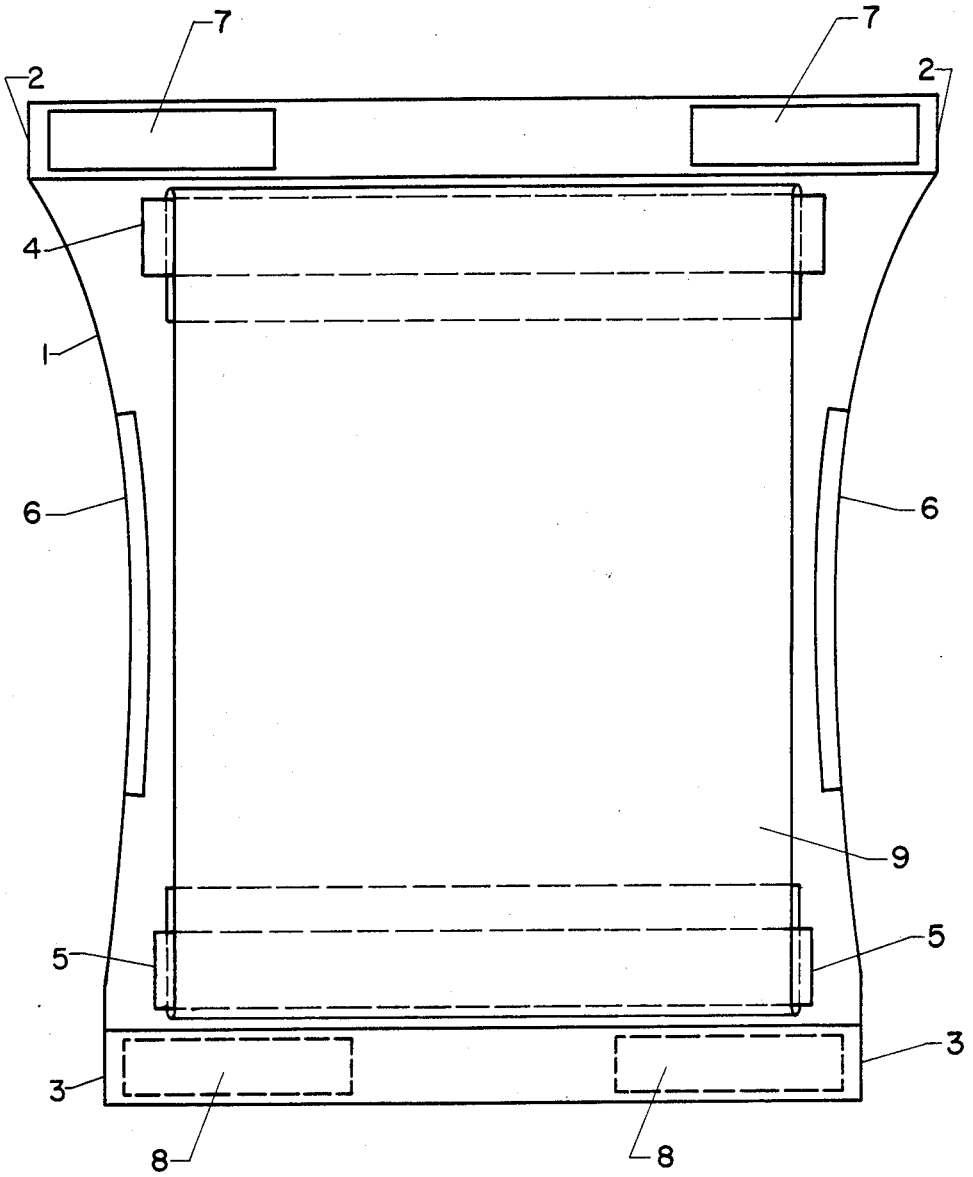
FIG. 2 shows how a cloth diaper No. 9 is placed up, over and under the top No. 4 and the bottom No. 5 loops to hold it securely in place.
Figure 3:
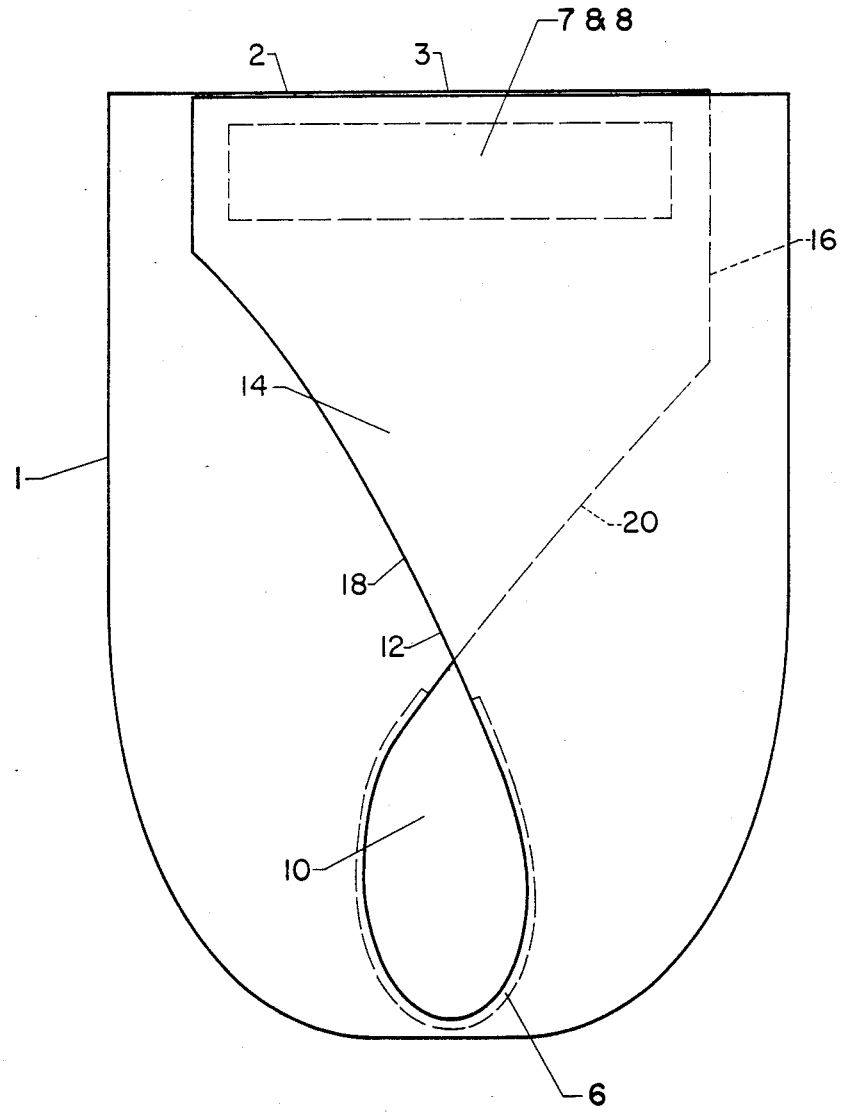
FIG. 3 is a side view which shows how the invention works, the bottom hook fastener No. 8 is brought up and fastened to the top pile fastener No. 7 which is on the inside top. No. 6 shows the elastic gathered to form the leg openings.
Figure 4:
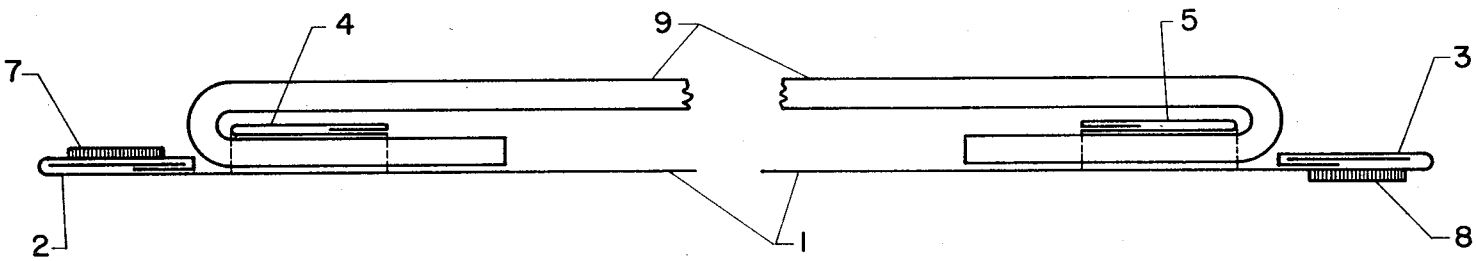
FIG. 4 is a flat view showing the Velcro loop on the inside of the top waistband No. 2 and the hook fastener No. 7 on the outside of the bottom waistband No. 3. It shows how the cloth diaper No. 9 is held securely in the top No. 4 and the bottom No. 5 plastic loops.
Figure 5:
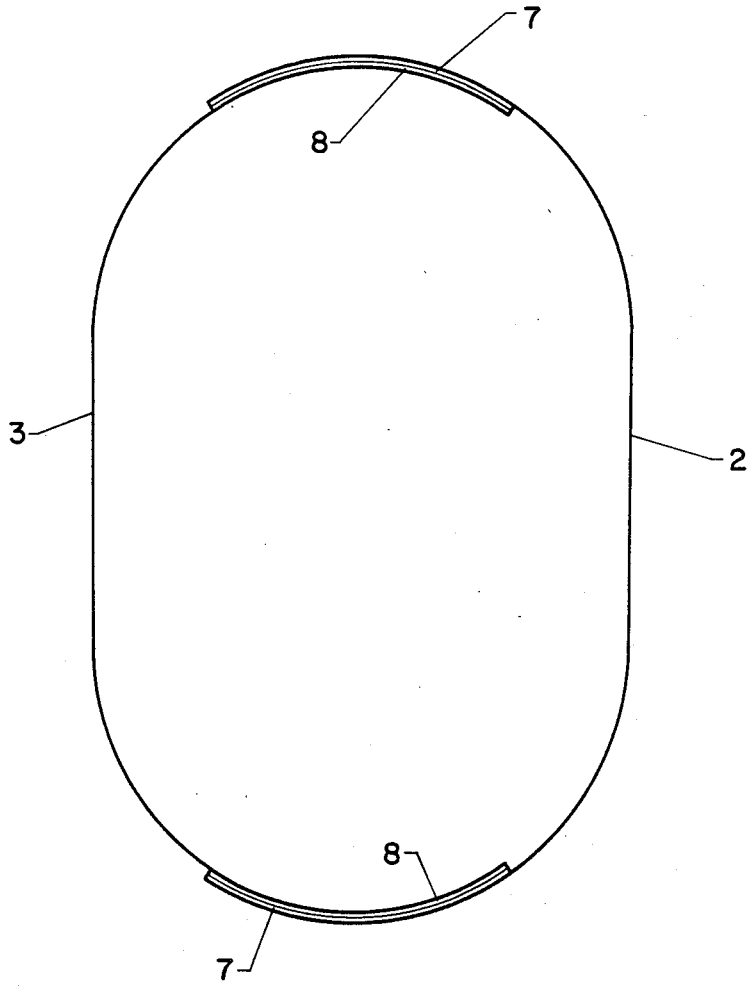
FIG. 5 is a top view showing the function of the releasable closing, the top waistband pile fastener No. 2 is brought around and fastened to the bottom waistband No. 3 by applying the pile fastener loop No. 7 to the hook fastener No. 8.

As best appreciated from the view of FIG. 3, the diaper holder of the present invention forms pants upon each of the releasable hook/pile fabric fastening portions 7 and 8 of the front waistband portion (3 in FIG. 2) being secured to a complimentary one of the fastening portions of the back waistband portion (2 in FIG. 2). As shown, each of the contractable leg portions 6 defines a leg opening 10. Each of the sides 12 (see also FIGS. 1 and 2) has an overlapping portion 14 disposed to overlap a corresponding overlapped portion 16 of the same side 12. As will be readily appreciated from the position of fasteners 7 and 8 shown in FIG. 3, the overlapping portion 14 is movable relative to the corresponding overlapped portion 16 from the leg opening 10 up to the waistband portions 2 and 3. This arrangement with movable overlapping portions will most advantageously allow air to circulate under the overlapping portions. As shown, the overlapping portion 14 and the overlapped portion 16 have curved edges 18 and 20 respectively which extend up from the corresponding leg opening 10.

As shown in FIGS. 1 and 2, each of the sides extending between the waistband portions 2 and 3 extend inwardly to narrow at a point intermediate the waistband portions. As shown in the drawings, the intermediate point is along the elastic contractable leg portions 6. Specifically, each side extends inwardly at least from each of the bands 4 and 5 to the intermediate point, as clearly shown in FIGS. 1 and 2. Each side is pointless from the back waistband portion 2 (top in FIGS. 1 and 2) to the front waistband portion 3 (low end of FIGS. 1 and 2), meaning that there are no sharp ends along this side. As shown, each of the sides has a continuous curve from the back waistband portion to at least the front diaper-holding band 5.

While the above description contains many specifications these should not be construed as limitations on the scope of the invention but rather as an exemplification of one preferred embodiment thereof. Many other variations are possible, for example they can be made in sizes from infant through adult for children, the mentally handicapped and the elderly. They can be used as a liner in the matching pants of diaper sets and pajama bottoms for infants. A one inch wide length of elastic can be substituted for the plastic loops. Any other closing could be utilized as hooks, grippers, snaps, etc. The elastic could be gathered from just under the top waistband along the leg openings to just under the bottom waistband to give a tighter fit in the legs. An absorbent liner or diaper pad with adhesive strips on the back could be manufactured to fit. They could be stamped out of plastic with welded or laminated edges and waistbands or any other process available.

I claim:

1. A diaper holder comprising a plastic piece extending between an inextensible back waistband portion and an inextensible front waistband portion along two sides, each waistband portion having two ends, each side having an elastic member to provide elastic contractable leg portions by gathering at least part of the side, front and back inextensible bands attached to said plastic piece to extend lengthwise along and adjacent to said respective front and back waistband portions and operable to hold a cloth diaper or disposable pad placed over and under the bands, each of said waistband portions having a releasable hook/pile fabric fastening portion at least at each of its ends, and wherein said diaper holder forms pants upon each of said fastening portions of said front waistband portion being secured to a complimentary one of said fastening portions of said back waistband portion with each contractable leg portion defining a leg opening, each side having an overlapping portion disposed to overlap a corresponding overlapped portion of the same side, each overlapping portion movable relative to the corresponding overlapped portion from the leg opening up to the waistband portions such that air may circulate under the overlapping portions, and wherein said fabric fastening portions on said waistbands are fastenable so as to adjust the diaper holder for different sized waists.

2. The diaper holder of claim 1 wherein each of said waistband portions has a portion folded over to form a double thickness.

3. The diaper holder of claim 2 further comprising a fabric reinforcing piece within the double thickness of each waistband portion.

4. The diaper holder of claim 1 wherein each of said sides extends inwardly to narrow at a point intermediate between the waistband portions.

5. The diaper holder of claim 4 wherein each side extends inwardly from each band to the corresponding intermediate point.

6. The diaper holder of claim 5 wherein each side is pointless from said front waistband portion to said back waistband portion.

7. The diaper holder of claim 4 wherein each side has a continuous curve from one of said waistband portions at least to the other of said bands.

8. The diaper holder of claim 4 wherein, when the diaper holder is formed into pants, each of said overlapped portions has a curved edge extending up from the corresponding leg opening and each of said overlapping portions has a curved edge extending up from the corresponding leg opening.

9. The diaper holder of claim 1 wherein said fastening portions on said waistband portions are the only fasteners on the diaper holder.

* * * * *